US005084598A

United States Patent [19]

Nagata et al.

[11] Patent Number: 5,084,598

[45] Date of Patent: Jan. 28, 1992

[54] ELECTRIC SWITCH FOR A POWER TOOL

[75] Inventors: Kunio Nagata, Kyoto; Takezo Sano, Shiga; Saburou Morita, Izumo; Shoji Kazusaka, Takatsuki; Junzo Asa, Otsu; Satoshi Nozoe, Kyoto, all of Japan

[73] Assignee: Omron Corporation, Kyoto, Japan

[21] Appl. No.: 549,557

[22] Filed: Jul. 9, 1990

Related U.S. Application Data

[63] Continuation of Ser. No. 425,381, Oct. 16, 1989, abandoned, which is a continuation of Ser. No. 259,196, Oct. 18, 1988, abandoned.

[30] Foreign Application Priority Data

| | | | |
|---|---|---|---|
| Oct. 21, 1987 | [JP] | Japan | 62-161513[U] |
| Oct. 21, 1987 | [JP] | Japan | 62-267457 |
| Oct. 24, 1987 | [JP] | Japan | 62-269824 |
| Oct. 26, 1987 | [JP] | Japan | 62-271155 |
| Oct. 29, 1987 | [JP] | Japan | 62-274510 |
| Apr. 12, 1988 | [JP] | Japan | 63-49276 |
| Apr. 15, 1988 | [JP] | Japan | 63-51098[U] |
| Apr. 16, 1988 | [JP] | Japan | 63-51242[U] |
| Apr. 20, 1988 | [JP] | Japan | 63-52954[U] |
| Apr. 23, 1988 | [JP] | Japan | 63-55484[U] |
| Apr. 25, 1988 | [JP] | Japan | 63-55752[U] |

[51] Int. Cl.[5] ..... H01H 9/00; H01H 15/00

[52] U.S. Cl. ..... 200/16 C; 200/1 V

[58] Field of Search ..... 200/1 V, 16 R, 16 C, 200/16 D, 293.1, 302.1-302.3, 547-551, 553, 558; 338/198, 200, 215; 310/48, 50

[56] References Cited

U.S. PATENT DOCUMENTS

| | | | |
|---|---|---|---|
| 1,986,527 | 1/1935 | Rach et al. | 200/551 X |
| 2,356,521 | 8/1944 | Kochner | 200/550 |
| 2,837,609 | 6/1958 | Clayton et al. | 200/550 X |
| 2,900,460 | 8/1959 | Wallace | 200/16 R X |
| 3,221,115 | 11/1965 | Feher, Jr. | 200/16 R |
| 3,258,549 | 6/1966 | Stoi | 200/16 R |
| 3,311,719 | 3/1967 | Vananzi | 200/16 C |
| 3,502,825 | 3/1970 | Bailey et al. | 200/547 X |
| 3,674,953 | 7/1972 | Brevick | 200/550 X |
| 3,770,921 | 11/1973 | Wilbrecht | 200/16 R X |
| 3,780,249 | 12/1973 | Harper | 200/302.3 |
| 4,097,704 | 6/1978 | Piber | 200/1 V X |
| 4,179,644 | 12/1979 | Vassos | 318/17 |
| 4,698,464 | 10/1987 | Tanaka et al. | 200/16 D X |

FOREIGN PATENT DOCUMENTS

| | | |
|---|---|---|
| 48124 | 3/1982 | European Pat. Off. . |
| 2211027 | 2/1973 | Fed. Rep. of Germany . |
| 6222331 | 1/1987 | Japan . |

*Primary Examiner*—J. R. Scott

*Attorney, Agent, or Firm*—Fish & Richardson

[57] ABSTRACT

An electric switch for a power tool, comprising: a slider slidably received in a switch casing along a longitudinal direction, a handle provided in the grip of the power tool for manually actuating the slider along the longitudinal direction; a plurality of fixed contact pieces arranged in an internal bottom surface of the switch casing and provided with contact surfaces located substantially in a same plane; and a plurality of moveable contact pieces arranged in the bottom surface of the slider and urged toward the fixed contact pieces by spring members so as to selectively contact at least some of the contact surfaces of the fixed contact pieces. The contact portions of this switch achieve various conductive states by planar arrangement and movement of the contact pieces, the component parts can be fitted into a small switch casing, particularly having a small height. Since the component parts may be assembled one over the other in sequential manner without requiring special efforts, a substantial advantage can be gained in the improvement of the efficiency of the assembling process. And, these advantages can be gained without diminishing the reliability of the various states of contact between the various contact pieces.

15 Claims, 20 Drawing Sheets

ELECTRIC SWITCH FOR A POWER TOOL

This application is a continuation of U.S. application Ser. No. 07/425,381, filed Oct. 16, 1989, now abandoned, which is a continuation of U.S. application Ser. No. 07/259,196, filed Oct. 18, 1988, now abandoned.

TECHNICAL FIELD

The present invention relates to an electric switch for use in a power tool, such as electric screw driver, electric power drill, electric saw and so forth, and in particular to an electric switch for a power tool which is easy to assemble and convenient to use.

BACKGROUND OF THE INVENTION

Such an electric switch for a power tool is recently disclosed, for instance, in Japanese patent laid-open publication No. 62-22331 (Japanese patent application No. 60-160916) of prior application. This switch internally includes a power transistor for controlling the rotor circuit of the motor, a printed circuit board carrying the control circuit for controlling the torque output of the motor, and a switch mechanism connected to the control circuit.

The switch mechanism is provided with first through third moveable contact pieces which, to form a switch contact circuit, depend from a moveable piece which synchronizes with the actuating force of the actuation lever, and as the moveable piece undergoes a sliding motion, the moveable contact pieces are each interposed between the adjacent surfaces of a pair of contact pieces which oppose each other as fixed contact pieces, and a desired contact signal is obtained by the contact pieces at the time of this interposing movement.

In this case, the adjacent contact pieces are supported in the switch casing so that they can expand and elastically deform in the direction of the contact motion in order to obtain a certain contact pressure.

Therefore, considerable cares are required in positioning these contact pieces in optimal fashion after they are press fitted and crimped, by taking into account their elastic deformations, so that the contact pieces may not touch the inner wall surfaces of the switch casing and they may contact with the moveable contact pieces with uniform pressure when the contact pieces have fully expanded. This factor contributed to the loss of the assembly work efficiency and, hence, the loss of the production efficiency of the switch mechanism.

In such a switch, since manual actuation of the slider takes place by way of a lever which engages the slider at its one end and protrudes externally of the switch casing, typically from a lower part thereof, and since the lever moves relatively to the switch casing, a special sealing structure must be incorporated in the slot through which the actuation lever protrudes so as to accommodate the motion of the actuation lever with respect to the switch casing.

Further, the upper part of the switch casing must define an open cavity for the convenience of installing the switch contact mechanism therein and must be closed thereafter. Thus, as can be readily understood, the structure of the upper part of the switch casing is highly important in simplifying the assembly process thereof and ensuring the reliability of the switch contacts by protecting them from external influences.

BRIEF SUMMARY OF THE INVENTION

In view of such shortcomings of the prior art and the findings of the inventors, a primary object of the present invention is to provide an electric switch for a power tool which is improved in the efficiency of the required assembly work by eliminating the need for adjustment after they are assembled.

A second object of the present invention is to provide an electric switch for a power tool which is provided with a position for an electromagnetic braking action as well as the positions for the on-off of the motor and is yet compact in structure.

A third object of the present invention is to provide an electric switch for a power tool which ensures a favorable contact properties to the switch contacts.

A fourth object of the present invention is to provide an electric switch for a power tool which combines a variable resistor with the switch structure in a favorable arrangement.

A fifth object of the present invention is to provide an electric switch for a power tool which is easy to assemble but is provided with reliable structures in both the lower and upper parts of the switch casing.

A sixth object of the present invention is to provide an electric switch for a power tool which is well protected from the intrusion of moisture and dust but is provided with efficient means for dissipating the heat generated by the electronic component parts of the control circuit.

These and other objects of the present invention can be accomplished by providing an electric switch for a power tool, comprising: a slider slidably received in a switch casing along a longitudinal direction; handle means for manually actuating the slider along the longitudinal direction; a plurality of fixed contact pieces arranged in an internal bottom surface of the switch casing and provided with contact surfaces located substantially in a same plane; and a plurality of moveable contact pieces arranged in the bottom surface of the slider and urged toward the fixed contact pieces by spring means so as to selectively contact at least some of the contact surfaces of the fixed contact pieces.

According to the present invention, the assembly work consists of arranging the fixed contact pieces on the bottom surface of the switch casing, and arranging contact portions of the moveable contact pieces over the exposed contact portions of the fixed contact pieces in a planar fashion while urging the moveable contact pieces toward the fixed contact pieces by suitable means.

Thus, according to the present invention, the assembly work is simply performed by laying the fixed contact pieces and the moveable contact pieces one over the other, and, in particular, since the arrangement of the contact pieces and the relative motion between the fixed contact pieces and the moveable contact pieces are both planar, not only highly stable states of contact can be assured between various contact pieces but also the dimensions of the internal structure of the switch, in particular its height, can be substantially reduced.

According to a preferred embodiment of the present invention, the moveable contact pieces consist of a pair of laterally arranged contact pieces, and the fixed contact pieces comprise a common brake contact piece provided in an longitudinal end of the bottom surface of the switch casing, a pair of laterally spaced power source contact pieces arranged in the other longitudinal end of the bottom surface of the switch casing, and a pair of laterally spaced motor contact pieces each arranged between the brake contact piece and one of the power source contact pieces, each of the moveable contact pieces being adapted to electrically connect one of the motor contact pieces to the brake contact piece or one of the power source contact pieces depending on the longitudinal sliding position of the slider.

The moveable contact pieces may be either planar or M-shaped, and the spring means may consist of sheet springs, or coil springs. If coil springs are used, it is preferable to provide retaining means which elastically engage the end portions of the coil springs for the convenience of the assembly work. According to another preferred embodiment of the present invention, the springs means are integrally provided in the moveable contact pieces. For instance, the spring means may consist of the parts extending between the legs, inclusive of the legs, and the middle parts of the M-shaped moveable contact pieces. Preferably, the slider is provided with means for retaining the moveable contact pieces, such as the depending portions of the slider which are elastically interposed between the vertical walls of the moveable contact pieces defining the central depressions of the M-shaped moveable contact pieces.

According to yet another embodiment of the present invention, the first and second motor contact pieces are originally connected to each other by way of the brake contact piece, and the member which connects the brake contact piece with one of the first and second motor contact pieces is entirely located externally of the switch casing immediately after the contact pieces are insert molded with the switch casing. Thereby, the positioning of the contact pieces can be accomplished as the positioning of a single terminal piece. The separate contact pieces can be produced by cutting away the member which connects the brake contact piece with one of the first and second motor contact pieces.

According to a certain aspect of the present invention, a printed circuit board carrying a control circuit mounted on its upper surface and a resistor surface printed on its lower surface is placed on the upper part of the switch casing, and the slider is provided, on its upper surface, with a brush which slides over the printed resistor surface. The variable resistor consisting of the brush and the printed resistor surface can be used as a part of the circuit for controlling the speed or the torque output of the motor.

According to another aspect of the present invention, the switch further comprises an inner cover having a depending piece which presses upon a peripheral part of the printed circuit board against a shoulder surface provided in the upper part of the switch casing, and an outer cover which fits onto and securely engages with the outer peripheral surface of the switch casing. Thus, the interior of the switch casing accommodating the switch contact pieces is well sealed off from external influences without involving highly tight fitting structure which is detrimental to the simplification of the assembly process.

According to yet another aspect of the present invention, a semiconductor device is securely attached to the internal surface of the outer cover and the outer cover consists of highly heat conductive material. Thus, the cover can be used as both a heat radiator and a seal cover. An even more favorable result can be achieve if the inner cover is also made of highly heat conductive material and thermally in contact with the semiconductor device.

If each of the fixed contact pieces is connected to a corresponding terminal which is passed through a wall part of the switch casing located at a longitudinal end thereof, and the terminals are provided with annular and upward projections which are received by corresponding holes provided through printed electroconductive patterns of a printed circuit board carrying a control circuit for the motor of the power tool and secured to the upper end of the switch casing, and leads extending from an external circuit are inserted into the annular projections, each of the annular projections being soldered to the corresponding printed electroconductive pattern of the printed circuit board and the corresponding lead of the external circuit, the electric connections of the various parts of the switch is substantially simplified. The external circuit may consists of a power transistor which may be attached to the cover disposed above the printed circuit board.

The present invention can be favorable applied to the power tool structure where the handle means consists of a lever which is passed through a slot defined in a lower part of the switch casing and is pivotally supported with respect to the switch casing, the lever being provided with engagement means for acting upon the slider into causing the longitudinal movement by way of a pivotal movement of the lever and manual actuation surface for manually causing the pivotal movement of the actuation lever.

The slot can be favorably sealed from external influences in spite of the movement of the actuation lever if the slot is closed by a fixed elastic strip which defines a central opening for accommodating the pivotal movement of the lever, and a moveable elastic strip which is placed over the fixed elastic strip and is provided with a central engagement hole for receiving the inner end of the lever.

The sealing capability may be enhanced by providing a stepped structure in which the switch contacts are placed higher than the slot for admitting the actuation lever into the switch casing, and/or by providing, adjacent to the engagement means at the inner most end of the actuation lever, an arcuate projection extending along the longitudinal direction which is received by the slot in the lower part of the switch casing, and a pair of shoulder surfaces which are located on either side of the arcuate projection and adjoins the lower surface of the switch casing peripheral to the slot.

The moveable contact pieces may be omitted from the slider by providing an electric switch for a power tool, comprising: a slider slidably received in a switch casing along a longitudinal direction; handle means for manually actuating the slider along the longitudinal direction; a plurality of contact pieces arranged in an internal bottom surface of the switch casing, the contact pieces including at least one contact surface and at least one elastic piece extending over the contact surface defining a certain gap therebetween in the natural state of the elastic piece; and a cam surface provided in the lower surface of the slider which can press upon the elastic piece into contact with the contact surface depending on the position of the slider along the longitudinal direction.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
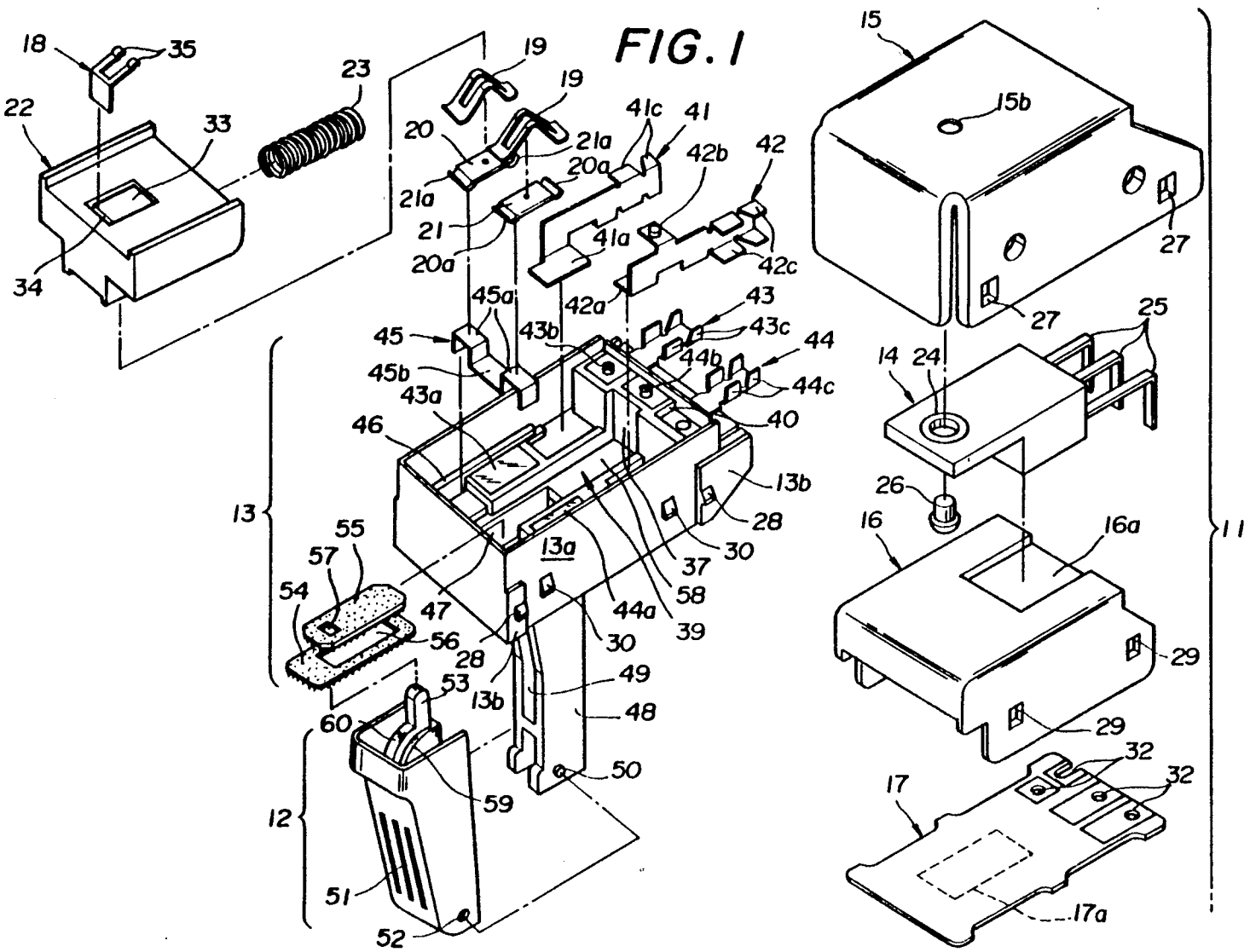
FIG. 1 is an exploded perspective view of a first embodiment of the electric switch for a power tool according to the present invention.
Figure 2:
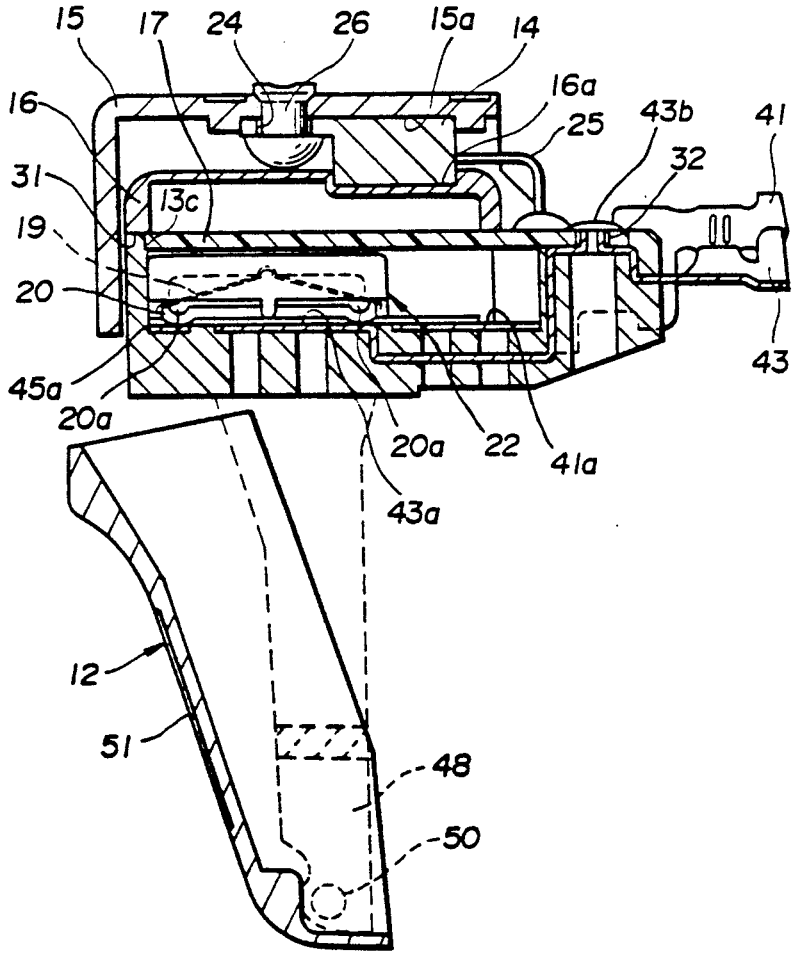
FIG. 2 is a sectional side view of the first embodiment.
Figure 3:
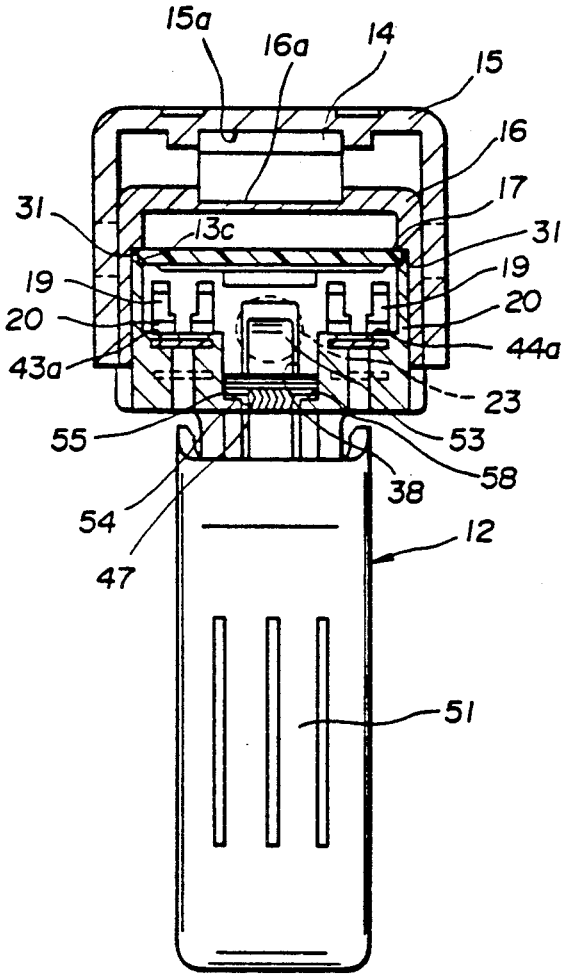
FIG. 3 is a sectional front view of the first embodiment.
Figure 4:
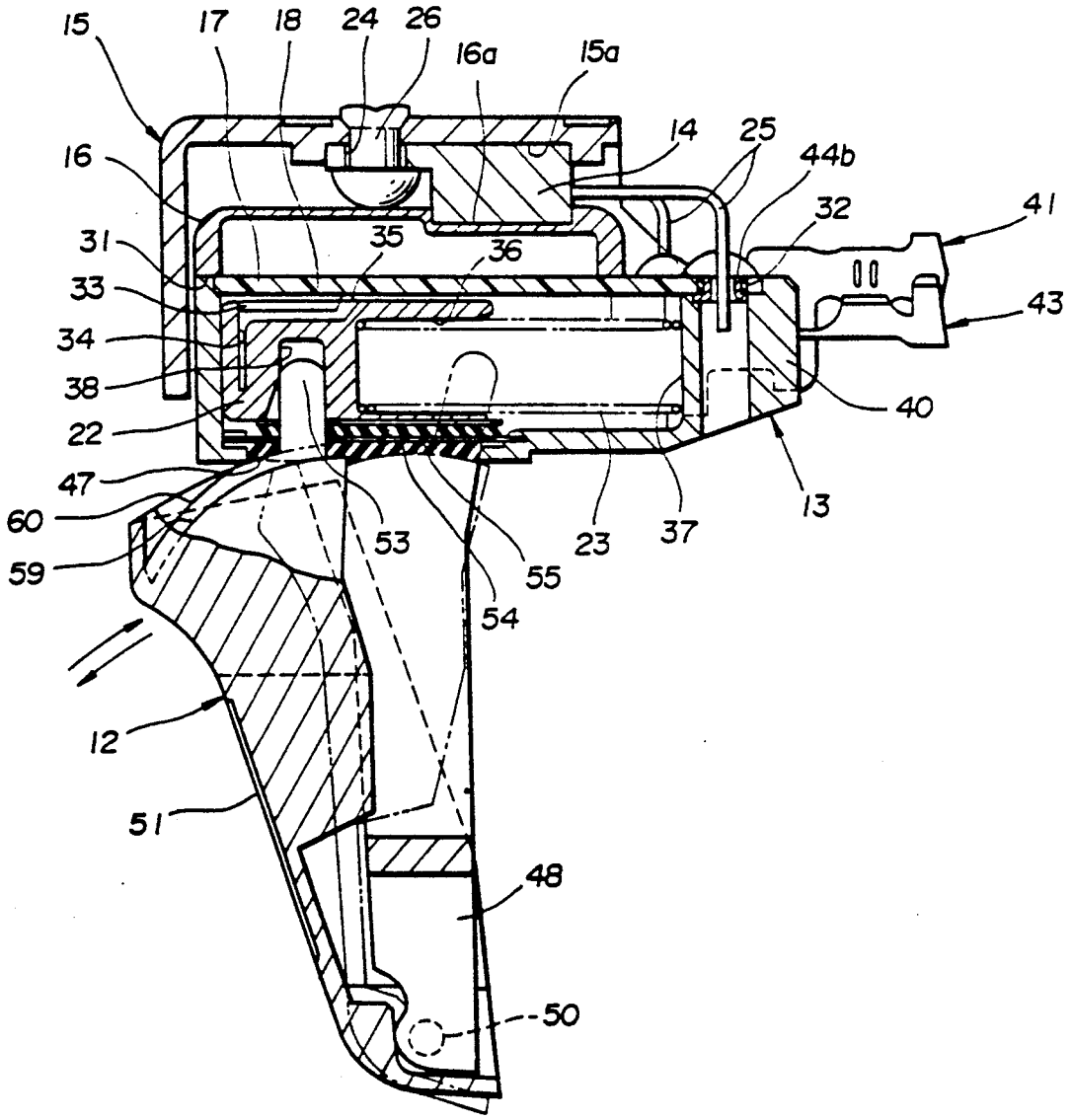
FIG. 4 is a view similar to FIG. 2 showing a different section.

FIGS. 1 through 6 generally illustrate the first embodiment of the electric switch for a DC motor powered power tool according to the present invention, and this electric switch comprises a control circuit unit 11 for the DC motor, an actuation lever 12 for controlling the action of the motor, and a switch casing 13 which integrally supports them. These parts are incorporated, for instance, in the grip of the power tool which may consist of, for instance, an electric screw driver.

The above described control circuit unit 11 comprises a power transistor 14, upper and lower heat radiation covers 15 and 16 which cover the power transistor 14 from above and below, a printed circuit board 17 carrying the control circuit for the motor, a slider 22 provided with first and second moveable contact pieces 20 and 21, which are urged by a constant biasing force by pressure springs 19 and 19, on its lower surface, a brush 18, provided on the upper surface of the slider 22, which varies a resistive value by sliding over a resistance control surface provided in the lower surface of the printed circuit board 17, and a return spring 23 for biasing this slider 22 in the forward direction.

The power transistor 14 is rectangular in shape, and is provided with a crimping hole 24 in its extension extending from its front end. This transistor 14 is attached to the upper heat radiation cover 15, and the three leads 25 projecting from the rear end for output control are bent downward and connected to the printed circuit board 17, as described hereinafter, to achieve the on-off control of the rotor circuit of the DC motor.

A power transistor of this type emits a considerable amount of heat and the heat emitted from this transistor is therefore is required to be removed by conducting the heat to the heat radiation covers 15 and 16 covering the transistor 14, from above and below. The upper and lower heat radiation covers 15 and 16 are made of highly heat conductive material such as aluminum alloy.

The upper heat radiation cover 15 is shaped as a box having an open bottom, and a depression 15*a* provided in the upper inner surface of this cover snugly receives the upper part of the power transistor 14. A rivet 26 which also contributes to the heat dissipation of the power transistor 14 is used to securely attach the power transistor 14 to the upper heat radiation cover 15 by being passed through the hole 24 of the transistor 14 and a hole 15*b* provided in the upper heat radiation cover 15 and by being crimped thereto. The lower heat radiation cover 16 is also shaped as a box with an open bottom, and is provided with a depression 16*a* on its upper surface for snugly receiving the lower part of the power transistor 14 therein.

The side walls depending from the top wall of the lower heat radiation cover 16 are provided with rectangular holes 29 which elastically catch lateral projections 30 provided in the switch casing 13 when the lower heat radiation cover 16 is fitted onto the switch casing 13. The side walls of the upper heat radiation cover 15 are also provided with similar rectangular holes 27 which likewise elastically catch lateral projections 28 provided in the switch casing 13. As can be understood from the drawings, the side walls of the switch casing 13 is provided with lower surfaces 13*a* and higher surfaces 13*b*; the lower heat radiation cover 16 is thus fitted onto the switch casing 13 by sliding along the lower surfaces 13*a*, and the external side surfaces of the lower heat radiation cover 16 are flush with the higher surfaces 13*b* when the lower heat radiation cover 16 is finally fitted onto the switch casing 13 and the lateral projections 30 are caught by the engagement holes 29. The upper heat radiation cover 15 thus slides along the external side surfaces of the lower heat radiation cover 16 and the higher surfaces 13*b* of the switch casing 13 until the engagement holes 27 thereof catch the lateral projections 28 of the switch casing 13. At the same time, the printed circuit board 17 is securely held between a shoulder surface 13*c* provided along the inner part of the upper end of the switch casing 13 and the lower end surface 31 of the lower heat radiation cover 16.

Thus, the switch casing 13, the printed circuit board 17, the lower heat radiation cover 16, the power transistor 14 and the upper heat radiation cover 15 are combined into an integral structure simply by assembling them one over the other. Since the power transistor 14 is entirely covered by the upper and lower heat radiation covers 15 and 16, the heat generated from the power transistor 14 is favorably dissipated by the heat radiation covers 15 and 16. In particular, the upper and lower heat radiation covers 15 and 16 are in mutual contact over such a wide area that the heat generated from the power transistor 14 is favorably directed to the upper heat radiation cover 15 which is relatively exposed to the exterior, and the printed circuit board 17 is protected from the influences of the heat from the power transistor 14. Also, the upper heat radiation cover 15 is provided not only with a large horizontal area but also with a large vertical area for a favorable heat removal. Furthermore, since the switch casing 13, the lower heat radiation cover 16 and the upper heat radiation cover 15 are mutually fitted closely with each other, the interior of the switch casing is extremely well protected from the intrusion of foreign matters such as moisture, dust and so forth.

The printed circuit board 17 carries electronic component parts for the control circuit on its upper surface, and has a resistance control surface 17*a* printed on its lower surface. And, the printed circuit board 17 is fixedly secured with the peripheral portion thereof being pressed downward by the lower heat radiation cover 16 against the switch casing 13 as described above.

The rear end portion of the printed circuit board 17 is provided with a plurality of holes (or slots) 32 by a burring process so as to extend therethrough for connecting terminals thereto, and the leads 25 of the power transistor 14, certain parts of the power terminals and the motor terminals are passed through these holes 31, from above and below, to be efficiently soldered thereto as described hereinafter. The holes 32 are defined by an electroconductive material, which is formed into an annular shape by a burring process, in the parts of the printed circuit board 17 where the terminals are to be connected, so that the fringes of these holes may be efficiently connected to various parts of the control circuit carried by this printed circuit board 17. The slider 22 opposes the lower surface of this printed circuit board 17.

The slider 22 is shaped as a box which can be accommodated in the switch casing 13, and the base end of the brush 18, shaped liked letter "L", is fitted into a brush mounting slot 34 provided in the front part of the upper surface of the slider 22 and defines a brush opening 33 for receiving the main part of the brush 18. The laterally bifurcated contact pieces 35 and 35 provided in the free end of this brush 18 are upwardly urged by its own spring force against the resistance control surface 17*a* on the lower surface of the printed circuit board 17 so that the resistive value for controlling the torque output or the speed of the motor may be varied by changing the point of contact between the resistance control surface 17*a* and the brush 18 which slides integrally with the slider 22.

The brush 18 is supported by the slider 22 which is normally biased forwardly by the compression coil spring 23 and the maximum resistive value is produced when the slider 22 is at its front most position while the minimum resistive value is produced when the slider 22 is at its rear most position.

The rear end of the lower surface of this slider 22 defines a spring receiving hole 36 for receiving an end of the return spring 23 whose other end is received and supported by another spring receiving hole 37 provided in the rear end of the interior of the switch casing 13 as described hereinafter whereby the slider 22 is normally biased forwardly under the spring force of the return spring 23 which is normally kept in compressed state.

The switch casing 13 is formed as a box having an open top as described above, and this upper opening 39 slidably receives the slider 22 along the fore-and-aft direction. The printed circuit board 17 and the power transistor 14 are placed over the upper opening 39 of the switch casing 13 by way of the heat radiation covers 15 and 16.

The inner surfaces of the side walls of the switch casing 13 are provided with a pair of shoulder surfaces 46 and 46 for guiding the slider 22 along the fore-and-aft direction while a central part of the bottom surface of the switch casing is provided with a slot 47 extending along the fore-and-aft direction for passing therethrough an actuation shaft 53 projecting from the upper end of the actuation lever 12.

From the lower surface of the switch casing 13 depends a support piece 48 which is provided with a communication slot 49 which opens out on the front surface of the support piece 48 and communicates with the central slot 47 located thereabove, and a pair of laterally extending pivot pins 50 and 50 provided on either side of the lower end thereof for pivotally supporting the actuation lever 12 as described hereinafter.

The actuation lever 12 is provided with a semicylindrical shape, and its cylindrical front surface serves as a depression actuation surface 51. By pivotally supporting a pair of pivot holes 52 provided on either side of its lower part with the pivot pins 50, the actuation lever 12 can rotate back and forth about its lower part. The front part of the lower surface of the slider 22 is provided with an engagement hole 38 for receiving the actuation shaft 53 projecting from the top end of the actuation lever 12, by way of the communication slot 49 and the central slot 47 so that the slider 22 may be moved along the fore-and-aft direction by way of the actuation shaft 53 as the actuation lever 12 is depressed and released manually.

The rear wall 40 of the switch casing 13 is provided with a first power source terminal 41 and a second power source terminal 42 press fitted in either outer most end thereof, and a first motor terminal 43 and a second motor terminal 44 are placed between these power source terminals 41 and 42 by insert molding them with the switch casing 13.

Contact surfaces 41*a* and 43*a* of the first power source terminal 41 and the first motor terminal 43 are arranged, with their upper surfaces exposed, one behind the other along one side of the bottom surface of the upper opening 39 while contact surfaces 42*a* and 44*a* of the second power source terminal 42 and the second motor terminal 44 are likewise arranged, with their upper surfaces exposed, one behind the other along the other side of the bottom surface of the upper opening 39. And, a brake contact piece 45 is press fitted into a front part of the bottom surface with its contact surfaces 45*a* and 45*a* exposed on either lateral side. These contact surfaces 41*a* through 45*a* are arranged on a common plane so that the required switching relationship for the motor output control can be accomplished by sliding the first and second moveable contact pieces 20 and 21 which are provided with arcuate contact portions 20*a* and 20*a*, and 21*a* and 21*a* at their longitudinal end portions of their under surfaces, along the fore-and-aft direction.

In this case, the first and second motor terminals 43 and 44 are used as common contact pieces with their contact surfaces 43*a* and 44*a* located at intermediate positions along the fore-and-aft direction, and the first and second moveable contact pieces 20 and 21 are normally placed across the contact surfaces of these common contact pieces and the contact surfaces 45*a* of the brake contact piece 45 to achieve the stationary state of the motor. When the slider 22 is moved rearwardly by way of the actuation lever 12 against the spring force of the compression coil spring 23, the first moveable contact piece 20 moves away from the contact surface 45*a* for the braking action and comes into contact with the contact surface 41*a* of the first power source terminal 41 to achieve a conductive state between the contact surfaces 41*a* and 43*a* provided on one side while the second moveable contact piece 21, likewise, moves away from the contact surface 45*a* for the braking action and comes into contact with the contact surface 42*a* of the second power source terminal 42 to achieve a conductive state between the contact surfaces 42*a* and 44*a* provided on the other side.

Further, from the upper surfaces of the parts of the terminals 42 through 44 adjacent to the rear wall 40 project annular connecting pieces 42*b*, 43*b* and 44*b* which can be inserted into the holes 32 provided by a burring process in the printed circuit board 17, from below, and can in turn receive the leads 25 of the power transistor 14, while the assembly process is conducted in sequential manner, without requiring any special efforts. Thus, the annular connecting pieces 42*b*, 43*b* and 44*b* are first inserted into the holes 32 of the printed circuit board 17, and the leads 25 of the power transistor 14 are then inserted into the central holes of the annular connecting pieces 42*b*, 43*b* and 44*b* so that they can be soldered together once and for all in a highly efficient manner. The rear ends of the power source terminals 41 and 42 and the motor terminals 43 and 44 are located externally of the switch casing 13, and they are provided with crimping terminal connection portions 41*c*, 42*c*, 43*c* and 44*c* which are formed so that they may be connected to external lead wires by crimping, instead of soldering, so as to achieve an improvement in production efficiency.

The first and second power source terminals 41 and 42 are connected to the corresponding poles of a battery not shown in the drawings while the first and second motor terminals 43 and 44 are connected to the reversion control switch for the motor which is also not shown in the drawings.

Here, the communication slot 47 provided in the lower part of the switch casing 13 is closed by a fixed foam material strip 54 and a moveable foam material strip 55 for sealing purpose; the fixed foam material strip 54 is centrally provided with an elongated opening 56 extending over a distance corresponding to the actuation stroke of the actuation shaft 53 for passing the actuation shaft 53 therethrough from below, and the front end portion of its upper surface is fixedly pressed downward by the central part 45*b* of the brake contact piece 45 against the bottom surface of the upper opening 39. The moveable foam material strip 55 is placed over it, and is provided with a small engagement hole 57 which receives the free end of the actuation shaft 53 therein. The intrusion of dust and other foreign matters from the lower part of the switch casing 13 is thus prevented.

Further, these foam material strips 54 and 55 are arranged in a central depression 58 provided in the bottom surface of the upper opening 39 so as to form a stepped structure, so that even when a small amount of dust has infiltrated into the switch casing 13, it is prevented from reaching the switch contact portions on account of the sealing action of the central depression 58. Thus, the intrusion of dust is prevented by the sealing action of the stepped structure as well as that of the foam material strips 54 and 55.

Figure 5:
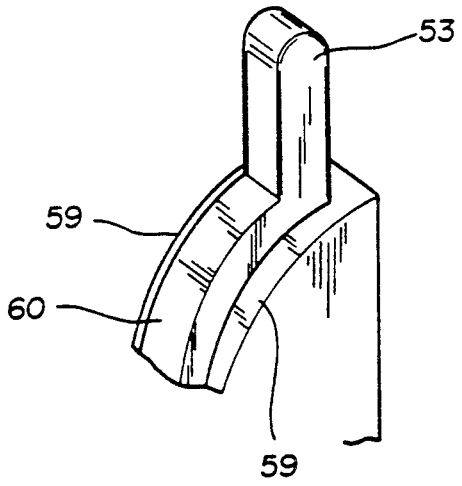
FIG. 5 is an enlarged perspective view of the inner most end of the actuation lever of the first embodiment.
Figure 6:
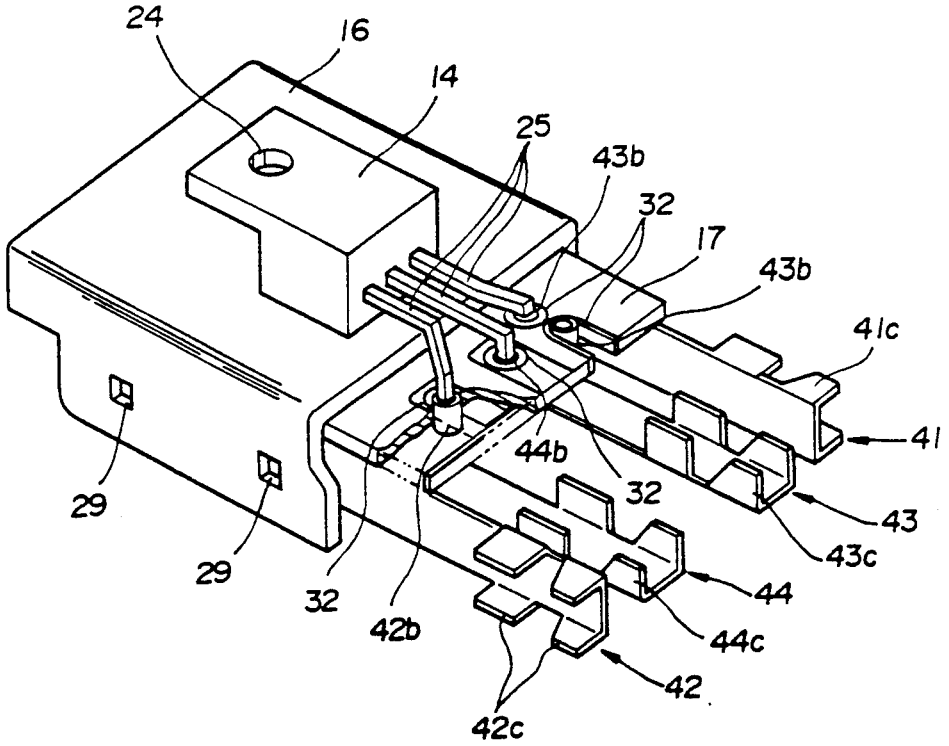
FIG. 6 is an enlarged perspective view of the terminal connection structure of the first embodiment.

Additionally, the upper end of the actuation lever 51 is provided with an arcuate projection 60 which extends generally along the fore-and-aft direction and defines a pair of likewise arcuate shoulder surfaces 59 along it (FIG. 5). The arcuate projection 60 is received by the central slot 47 and the shoulder surfaces 59 adjoin the parts of the lower surface of the switch casing 13 which define the central slot 47. Thus, this stepped structure of the upper end of the actuation lever 12 is also helpful in preventing the intrusion of foreign matters into the switch casing 13.

The electric switch for a DC motor powered power tool of this structure is arranged in the grip of the power tool, and the actuation lever 12 normally protrudes forwardly from the front surface of the grip so as to be ready to be depressed therefrom. By depressing this actuation lever 12, the slider 22 which cooperates with this actuation lever 12 moves rearwardly, whereby the first and second moveable contact pieces 20 and 21 are caused to move away from the brake contact piece 45, and the first moveable contact piece 20 comes into contact with both the first power source terminal 41 and the first motor terminal 43 while the second moveable contact piece 21 comes into contact with both the second power source terminal 42 and the second motor terminal 44. Thereby, electric power is supplied to the motor and the motor starts turning.

Here, as the point of contact between the brush 18 and the resistance control surface 17*a* of the printed circuit board 17, which is associated with the speed control circuit for the motor, is varied as a result of the depression stroke adjustment of the actuation lever 12, the torque output of the motor is variably controlled to a desired value which is suitable for the particular application. When the actuation lever 12 is depressed all the way by full stroke, the slider 22 reaches its rear most position, and the torque output of the motor is maximized.

When the depressed state of the actuation lever 12 is released, the slider 22 moves forwardly under the spring force of the return spring 23 and the actuation lever 12 also returns to its original inclined state, whereby the first and second contact pieces 20 and 21 are placed out of contact from the first and second motor terminals 43 and 44, respectively, and the power supply to the motor is discontinued.

In assembling this switch, prior to the soldering process, the actuation lever 12 is pivotally attached to the support piece 48 which depends from the lower surface of the switch casing 13 and the actuation shaft 53 is made to protrude inside the switch casing 13 from the central slot 47. The fixed foam material strip 54 and the moveable foam material strip 55 are placed on top of the actuation shaft 53, and this completes the assembly of the lower part of the switch casing 13.

Thereafter, the first power source terminal 41 and the second power source terminal 42 are press fitted into either side end portion of the rear wall 40 of the switch casing 13, and the brake contact piece 45 is press fitted into the front part of the upper surface of the upper opening 39. Thereby, the contact surfaces 41*a*, 41*b* and 45*a* of these terminals 41 and 42 and the brake contact piece 45, and the contact surfaces 43*a* and 44*a* of the first motor terminal 43 and the second motor terminal 44, which are insert molded with the switch casing 13 in advance, are exposed on the same plane in the bottom surface of the upper opening 39.

Further, the first and second moveable contact pieces 20 and 21 are placed over them by being fitted into the slider 22 with their upper surfaces urged downward by the springs 19 and 19, and these switch component parts are thus assembled one over the other. Thereafter, the printed circuit board 17, the lower heat radiation cover 16, the power transistor, 14, and the upper heat radiation cover 15 are assembled one over the other in similar fashion.

Thus, the assembly work can be completed simply by placing the power source terminals, the brake contact piece, the moveable contact pieces, the pressure springs and so forth one over the other on the bottom surface of the switch casing 13. In particular, since the power source terminals and motor terminals which correspond to the conventional fixed contact pieces are not required to be provided with the elastic property involving lateral expansion, no adjustment is required after the assembly work, and the assembly work efficiency is thus improved.

Furthermore, since the contact portions oppose each other from above and below in a planar fashion and slide over each other along the fore-and-aft direction also in a planar fashion, a highly stable state of contact can be assured.

When the requirement that the internally incorporated switch contact portions must be strictly free from dust is considered, the states of fit between the various parts in the upper part of the switch casing is desired to be as tight as possible. However, in that case, the convenience of the assembling process may be sacrificed. For instance, if the states of fit are too tight, the printed circuit board could be inadvertently installed in slanted orientation because the printed circuit board could be caught by the upper surface or the inner wall surface of the switch casing during the assembling process.

Figure 7:
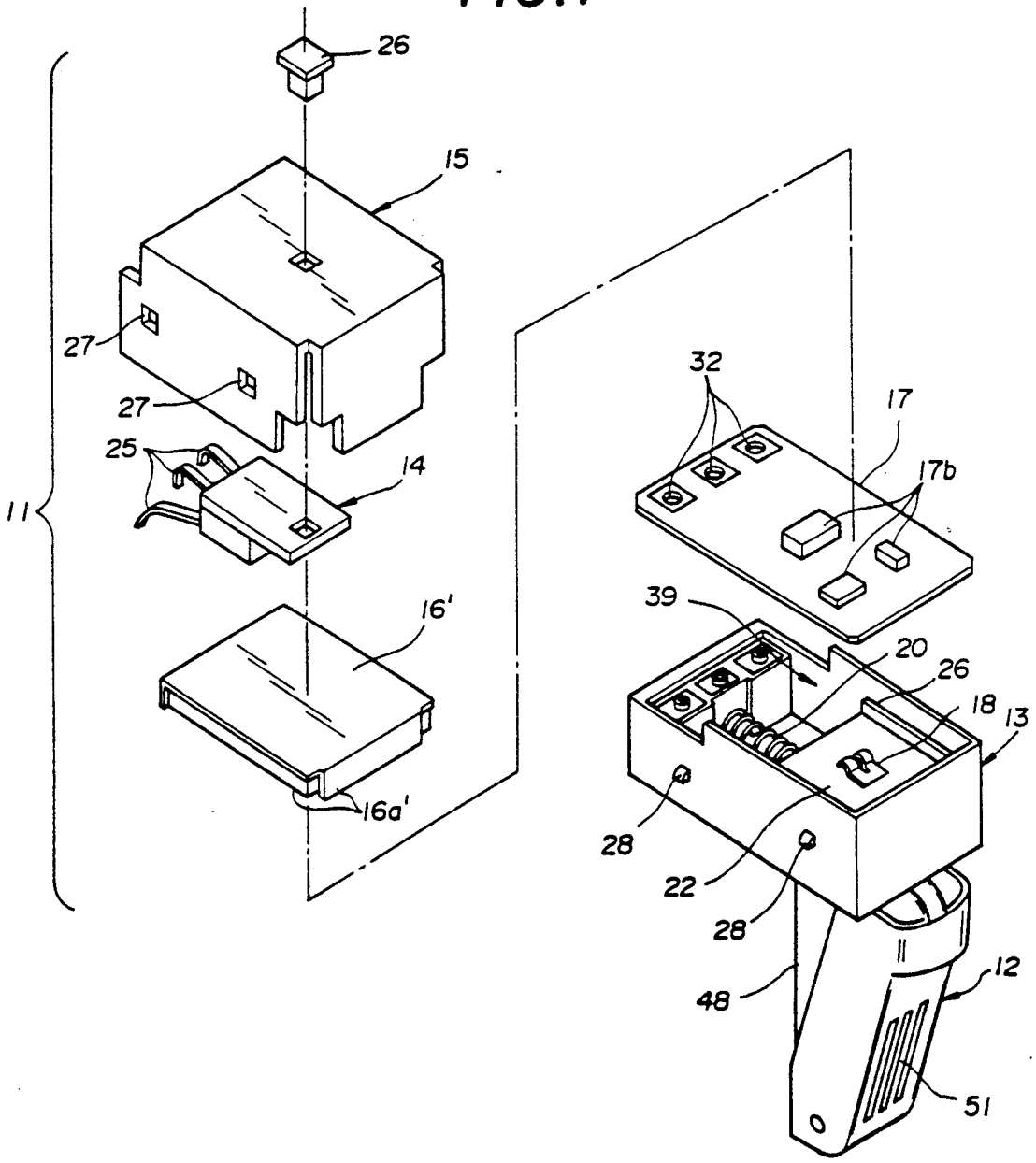
FIG. 7 is an exploded perspective view of an alternate structure for mounting the printed circuit board in the switch casing.
Figure 8:
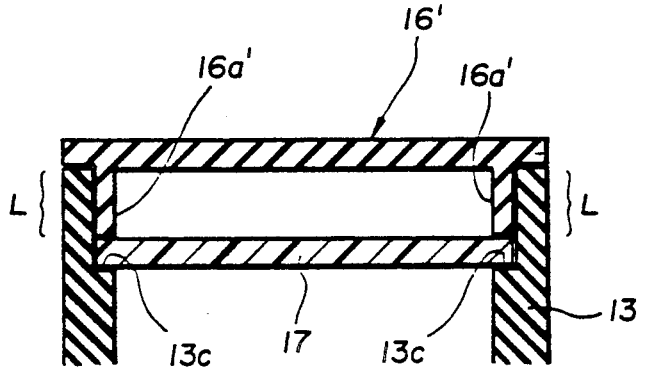
FIG. 8 is a sectional front view of the embodiment shown in FIG. 7.
Figure 9:
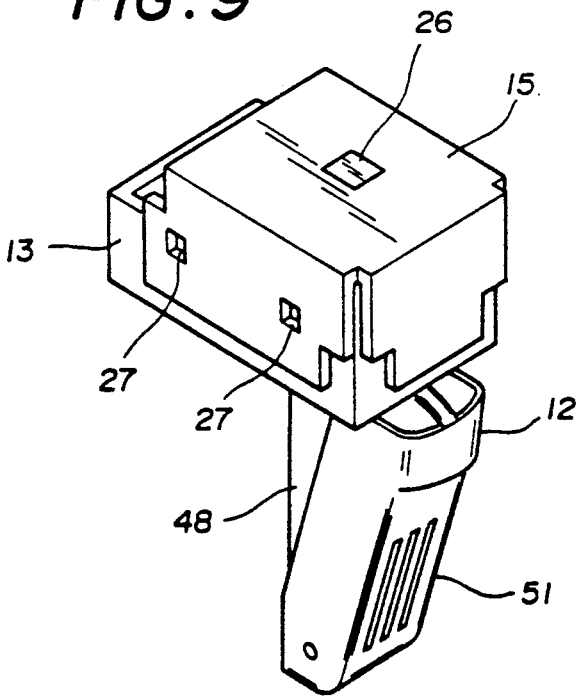
FIG. 9 is an external perspective view of the embodiment shown in FIG. 7.

The embodiment illustrated in FIGS. 7 through 9 makes the assembly work easier without diminishing the capability of the structure to prevent the intrusion of foreign matters. The parts corresponding to those of the previous embodiments are denoted with like numerals, in some case, without describing them again.

In the embodiment illustrated in FIGS. 7 through 9, an anti-dust cover 16' made of synthetic resin material is used in place of the lower heat radiation cover 16 of the first embodiment. This anti-dust cover 16', which is generally planar and conformal to the rectangular printed circuit board 17, covers the upper surface of this printed circuit board 17. Further, from the periphery of the anti-dust cover 16' depends a pressure piece 16*a'* which corresponds to the peripheral part of the upper surface of the printed circuit board 17.

This pressure piece 16*a'* is generally planar and vertically extends along the upper inner wall surface of the switch casing 13 so that the capability to prevent the intrusion of dust may be improved by closing the upper opening 39 of the switch casing 13 with this anti-dust cover 16'.

In this case, as shown in FIG. 8, when the anti-dust cover 16' is mounted to the switch casing 13, since the pressure piece 16*a'* of the anti-dust cover presses upon the printed circuit board 17 against the shoulder surface 13*c* of the switch casing 13 and the distance of overlap L between the upper inner wall surface of the switch casing 13 and the external surface of the pressure piece 16*a'* extending along it can be made large, the printed circuit board 17 is always properly positioned without requiring any special efforts and a high dust preventing capability can be obtained.

Figure 10:
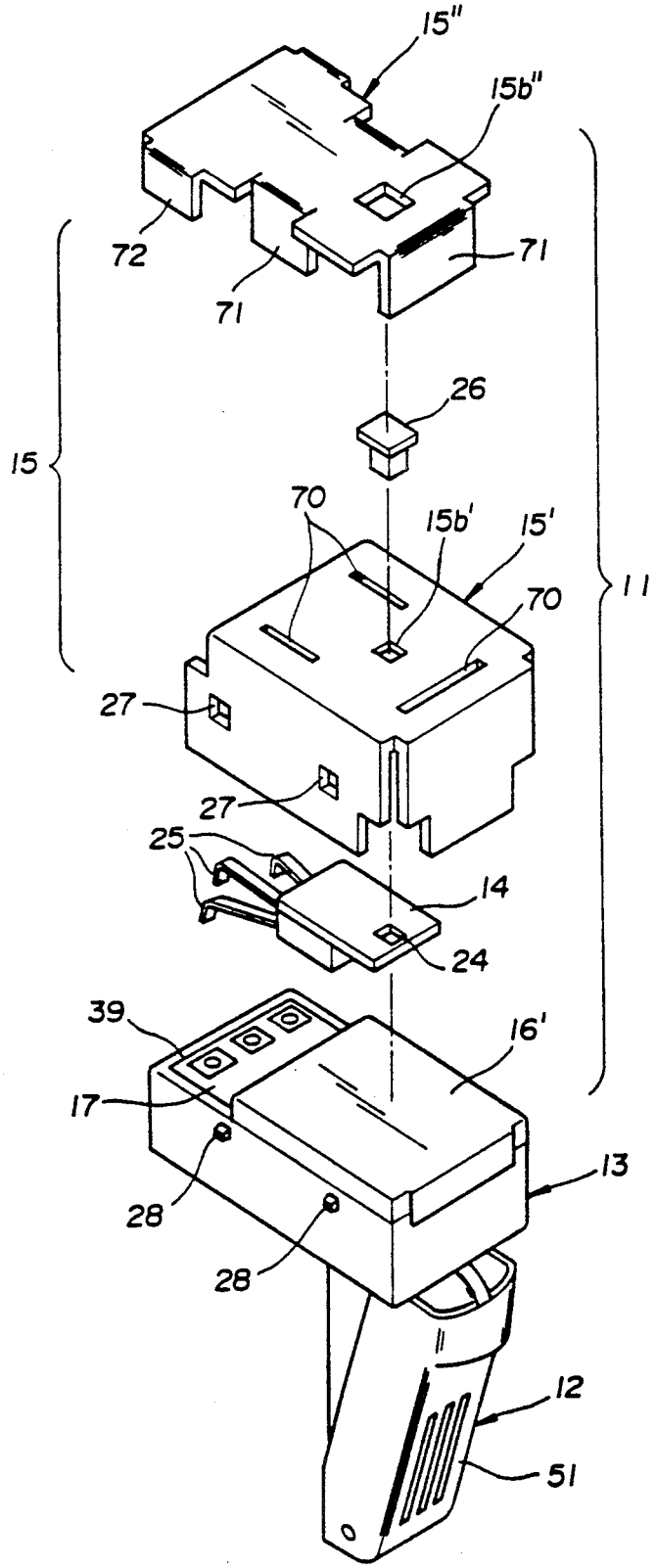
FIG. 10 is an exploded perspective view of another alternate structure for mounting the printed circuit board in the switch casing.
Figure 11:
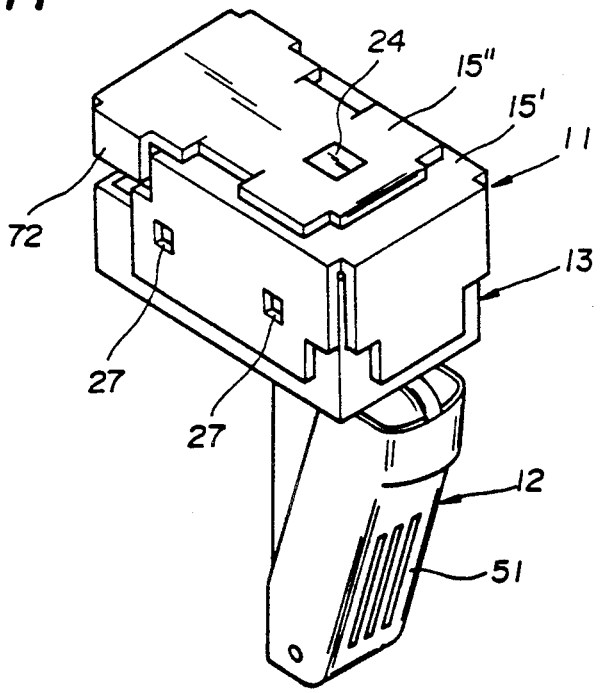
FIG. 11 is an external perspective view of the embodiment shown in FIG. 10.

The upper heat radiation covers 16 in the preceding embodiments were limited in their volumes and surface areas because of the requirements related to the material cost and the cost for the manufacturing facilities as well as the space requirements. In the modified embodiment illustrated in FIGS. 10 and 11, the capability of the upper heat radiation cover to remove the heat generated from the power transistor 14 is improved.

According to this embodiment, the upper heat radiation cover 15 consists of two parts 15' and 15'' which are both made of heat conductive material such as aluminum alloy.

The lower part 15' is shaped as a box with an open bottom, and is provided with rectangular holes 27 in its side walls for engagement with the lateral projections 28 provided in the switch casing 13. Thus, the lower part 15' is provided with not only with a horizontal surface but also vertical surfaces, all having substantially large surface areas which are helpful in preventing the intrusion of dust and other foreign matters as well as in removing the heat generated from the power transistor 14. The upper surface of the lower part 15' is provided with a few elongated slots 70 as well as a rectangular hole 15*b'* for receiving the rivet 26 for securing the power transistor 14.

The upper part 15'' is substantially planar and conformal to the upper surface of the lower part 15', and is provided with depending pieces 71 which are bent downward from the main part of the upper part 15'' and are adapted to be fitted into the corresponding slots 70 provided in the upper surface of the lower part 15', as well as a rectangular hole 15*b''* for receiving the head of the rivet 26 for securing the power transistor 14. Further, a pair of depending pieces 72 are bent from the main part of the upper part 15'' adjacent to its rear end and extend adjacent to and along the rear end surface of the lower part 15'.

By providing these depending pieces 71 and 72 serving as heat radiation fins, the capability of the upper heat radiation cover 15 to remove heat is improved. Also, by thus combining the two parts 15' and 15'', the overall volume, the thickness of the main (horizontal) part and the overall surface area of the upper heat radiation cover 15 are increased for the give thickness of the material consisting of sheet metal made of aluminum alloy. Further, since the two parts 15' and 15'' can be joined by the rivet 26 at the same time as securing the power transistor 14, the assembly work is not made any more costly or time-consuming than in the cases of the single-piece upper heat radiation covers of the preceding embodiments.

In the preceding embodiment, each of the moveable contact pieces were provided with a pressure spring consisting of a sheet spring. However, in the embodiment illustrated in FIGS. 12 and 13, no pressure springs are used because the moveable contact pieces themselves are provided with the required elastic property. In this embodiment again, the parts corresponding to those of the preceding embodiments are denoted with like numerals, in some cases, without describing them again.

Figure 12:
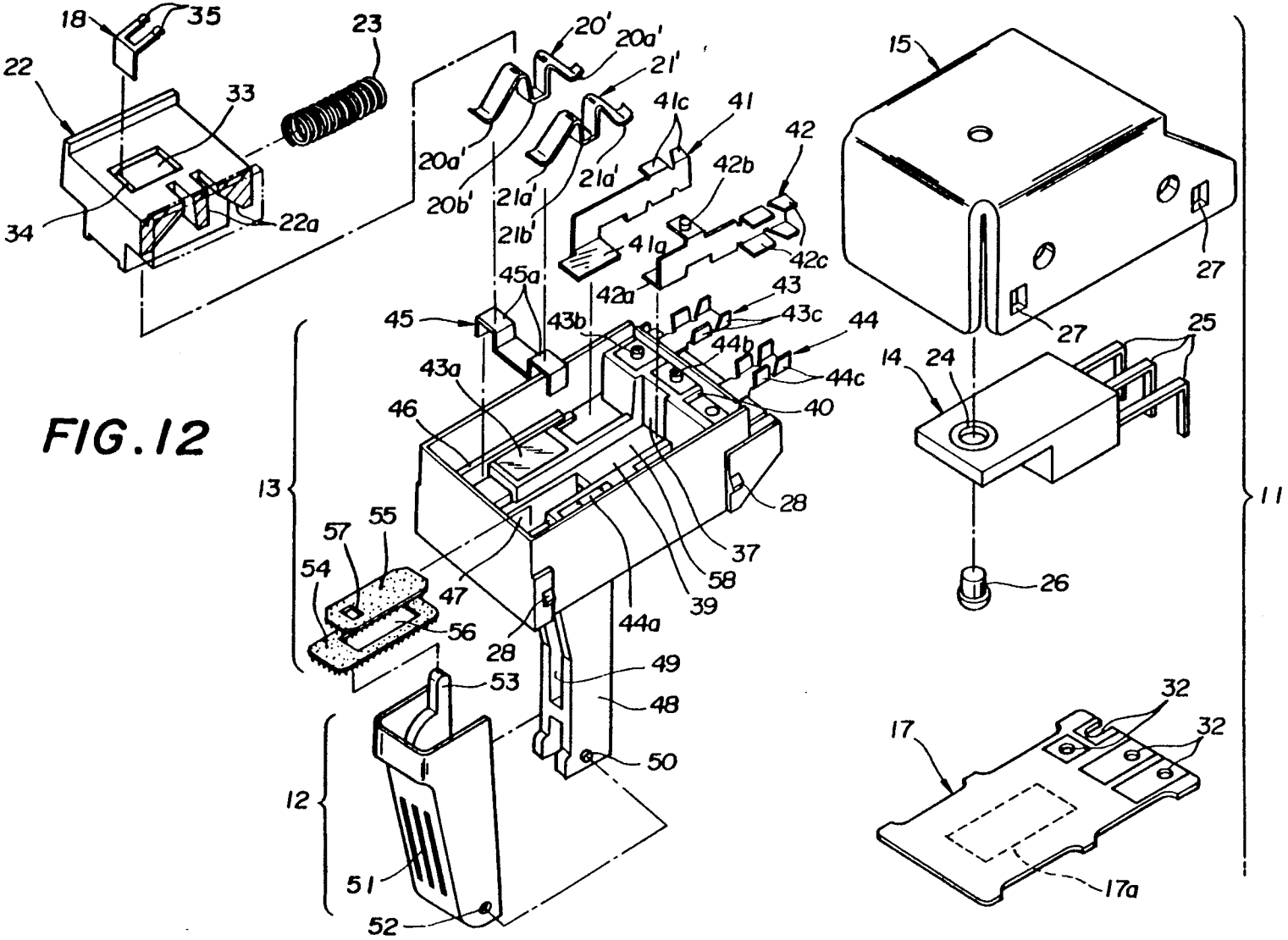
FIG. 12 is an exploded perspective view of a second embodiment of the electric switch for a power tool according to the present invention.
Figure 13:
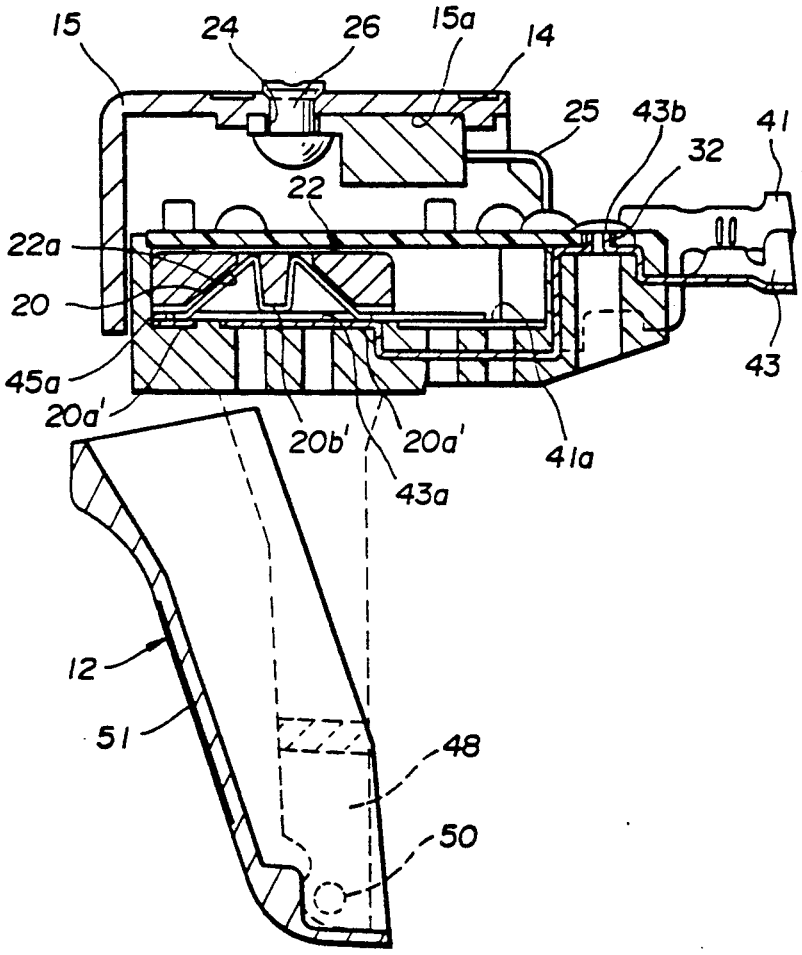
FIG. 13 is a sectional side view of the second embodiment.

Referring to FIGS. 12 and 13, the lower surface of the slider 22 is provided with a pair of M-shaped recesses 22*a* and 22*a* on either side thereof for receiving and retaining the first and second moveable contact pieces 20' and 21' therein, respectively.

The first and second moveable contact pieces 20' and 21' are each made by bending an electroconductive plate into the shape of letter "M" so as to impart them the elastic biasing property for contact with the contact pieces; the upwardly facing surface of the central depression 20*b'* or 21*b'* of each of the M-shaped moveable contact pieces 20' and 21' is pressed, from above, by the corresponding depending piece of the M-shaped recesses 22*a* provided in the the lower surface of the slider 22, and this depending piece is elastically interposed by the vertical portions of the moveable contact piece on either side of the upwardly facing surface of its central depression 20*b'* while the lower ends of the two legs of the M-shaped moveable contact pieces 20' and 21' are curved into arcuate contact portions 20*a*, 20*a*, 21*a* and 21*a* so that they may be aligned along the sliding direction one behind the other for each of the moveable contact pieces 20' and 21' and slidably engaged with the contact surfaces 41*a* through 45*a*, urged downward by the elastic spring forces of the legs of the moveable contact pieces themselves 20' and 21', the sliding contact being conducted in a planar fashion.

Thus, according this embodiment, the need for pressure springs is eliminated, and not only the material cost is reduced but also the assembly is substantially simplified.

In a switch of this type, at least some of the terminal pieces are desired to be insert molded with the switch casing to impart a favorable sealing property and obtain a mechanically integral structure. However, in insert molding the terminal pieces with the switch casing, a considerable care is require to accurately position all the fixed contact pieces which are to be inset molded prior to the process of insert molding, and a special skill is required to efficiently conduct this positioning work in short time. This factor contributes to the high cost of the switch.

Figure 14:
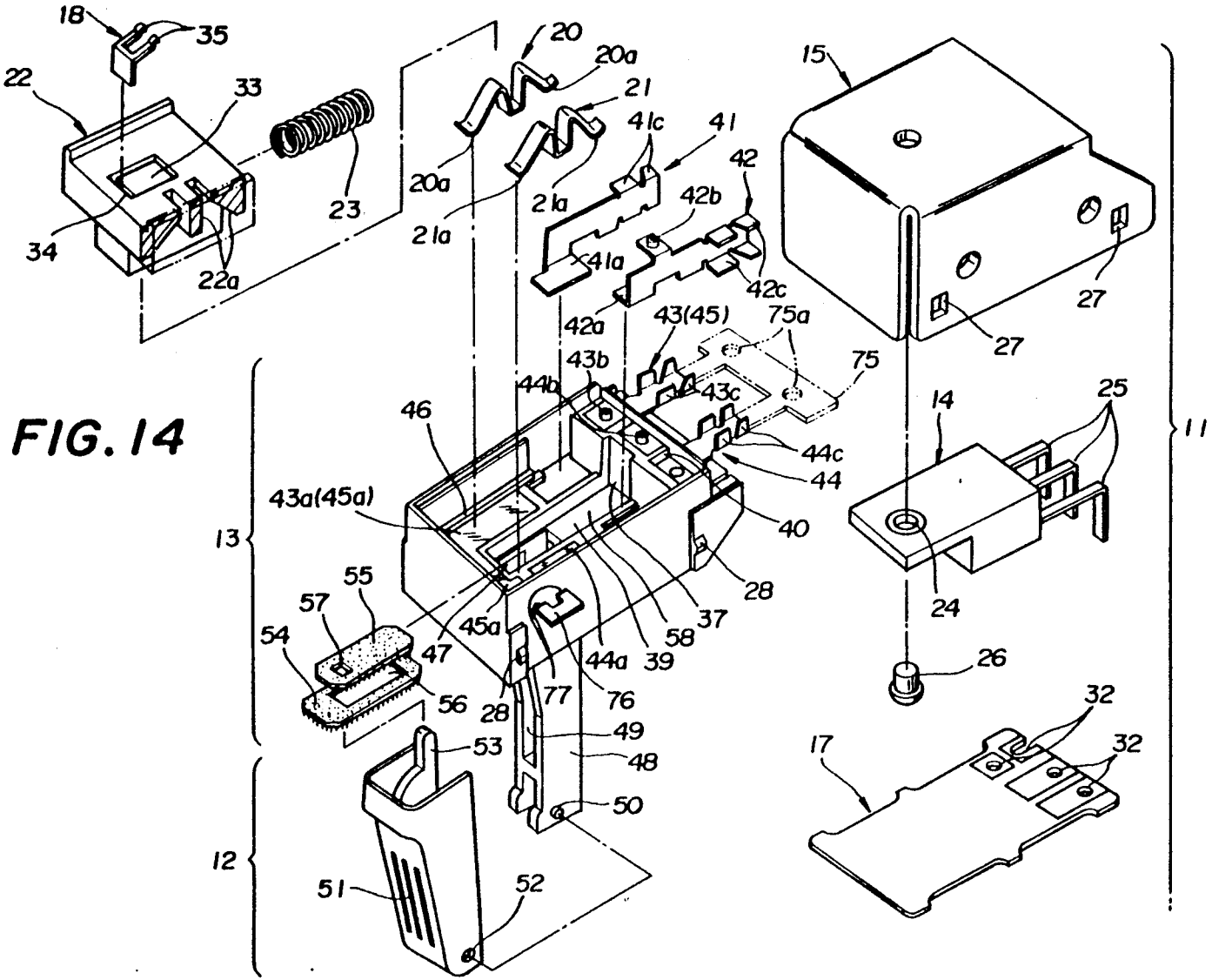
FIG. 14 is an exploded perspective view of a third embodiment of the electric switch for a power tool according to the present invention.

The embodiment illustrated in FIGS. 14 eliminates this problem by simplifying the work involved in positioning the terminal pieces with respect to the switch casing. In this embodiment also, the parts corresponding to those of the preceding embodiments are denoted with like numerals, in some cases, without describing them.

Figure 15:
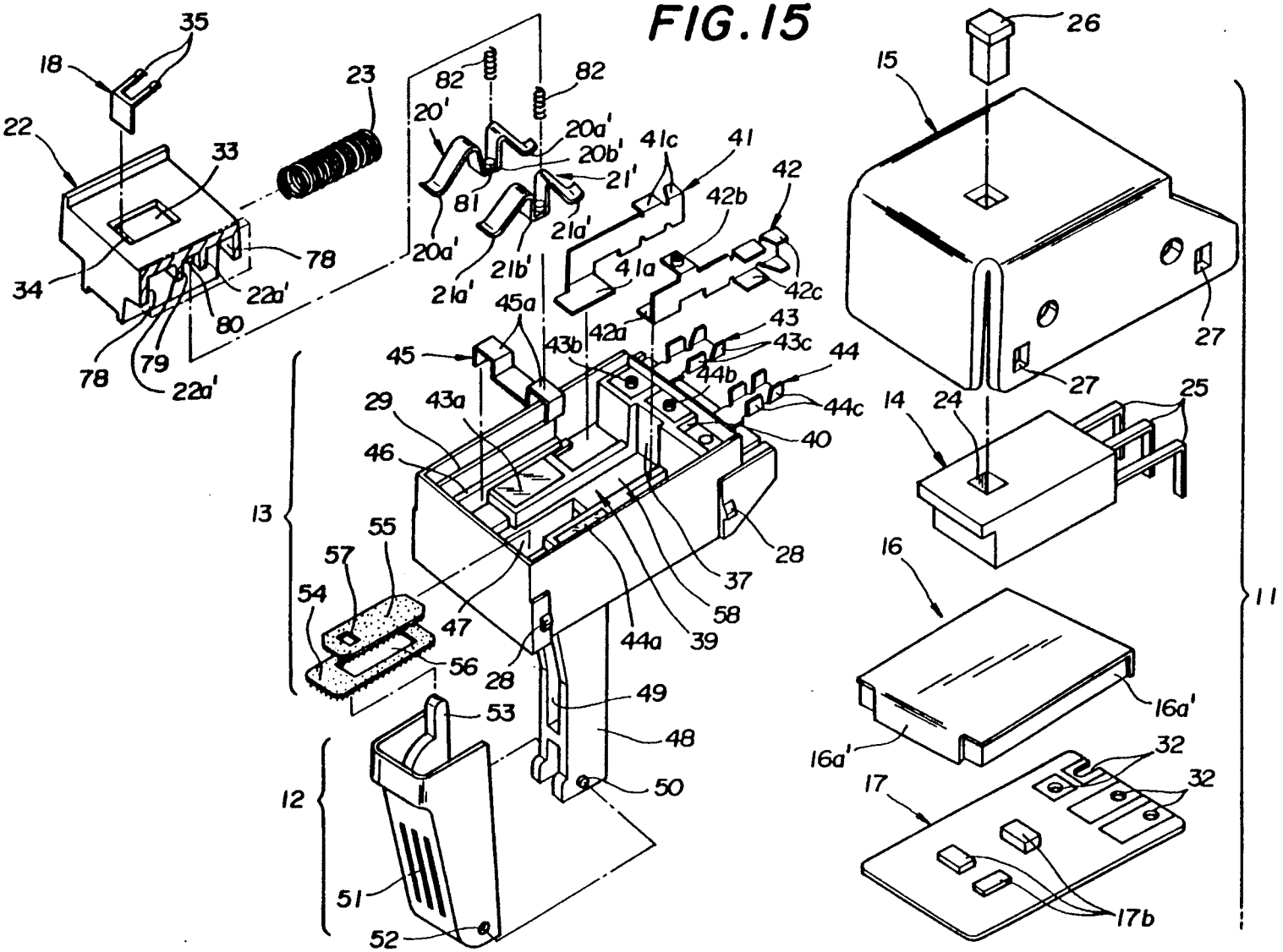
FIG. 15 is an exploded perspective view of a fourth embodiment of the electric switch for a power tool according to the present invention.

Referring to FIG. 14, according to the present embodiment which is similar to the embodiment shown in FIGS. 12 and 13 except for the structures of the fixed contact pieces, before the brake contact piece 45 is insert molded with the switch casing 13, as shown by the imaginary lines in FIG. 15, the brake contact piece 45 and the two motor terminals 43 and 44 are built as a single terminal piece having the brake contact piece 45 at its front end and the first and second motor terminals 43 and 44 extending in mutually parallel relationship from the two lateral ends of the brake contact piece 45 located in the front part of this single terminal piece and a base plate 29 extending across the rear ends of the motor terminals 43 and 44, so that these three parts may be insert molded as a single terminal piece.

A middle part of the second motor terminal 44 is provided with a removable connecting piece 76 so as to protrude externally from the switch casing 13 so that the motor terminals 43 and 44 and the brake contact piece 45 may be efficiently and simultaneously arranged on the bottom surface of the switch casing 13 by removing the removable connecting piece 30 at the boundaries 77 on the external surface of the switch casing 13 following the process of insert molding. The contact portion 45*a* of the brake contact piece 45 adjacent to the contact portion 43*a* of the first motor terminal 43 is left connected to the contact portion 43*a* of the first motor terminal 43 because the functions of these contact portions are not affected by it as can be readily understood.

If the removable connecting piece 76 is provided with notches or the like at its base ends or the boundaries 77, the removal of the removable connecting piece 76 following the process of insert molding is simplified. In the drawing, numeral 75*a* denotes pilot holes for the convenience of positioning the terminal piece prior to the insert molding process.

In manufacturing the switch casing 13 by injection molding resin material into a metallic mold for defining the shape of the switch casing, since the first motor terminal 43, the second motor terminal 44 and the brake contact piece 45 are built as a single terminal piece, these three parts may be positioned in highly exact locations in the metallic mold, simply and without requiring complicated positioning jigs, before the insert molding takes place.

When the insert molding is finished, the brake contact piece 45 and the first and second motor terminals 43 and 44 are arranged in the front part and on either side of the rear part of the bottom surface of the upper opening 39 of the switch casing 13, respectively, while an intermediate part of one of the motor terminals 44 protrudes externally out of the switch casing 13 as the removable connecting piece 76.

By cutting away this removable connecting piece 76 after insert molding it with the switch casing 13, the brake contact piece 45 and the second motor terminal 44 are separated from each other.

Thus, simply by removing the removable contact piece after the process of insert molding it with the switch casing, the mutually separated motor terminals and the brake contact piece can be arranged simultaneously in an efficient manner, and the process of insert molding involving only a single terminal piece results in a plurality of accurately positioned terminal pieces in the end. Therefore, the need for individually positioning a large number of terminal pieces is eliminated, and the manufacturing efficiency of the switch can be improved.

It is essential in a switch of this type to attain a favorable state of contact between the moveable contact pieces and fixed contact pieces because excessively small contact pressure causes poor contact while and excessively large contact pressure causes impairment of insulation due to generation of metallic powder from abrasion, as well as the loss of durability due to premature wears. In order to achieve a favorable state of contact between the moveable contact pieces and the fixed contact pieces, the use of coil springs for biasing the moveable contact pieces against the fixed contact pieces is preferred not only because coil springs are more uniform in elastic property but also because they may be used in pre-compressed state so that the biasing force may not vary much in relation with the displacement of the moveable contact pieces.

It is readily conceivable to use a coil spring which can maintain a relatively fixed contact pressure in a switch of this type, but a small coil spring can easily come off during the assembly process, and so much care is required to fits it in place that the efficiency of the assembly work tends to be extremely poor.

The embodiment illustrated in FIGS. 15 through 19 is intended to solve this problem.

Figure 16:
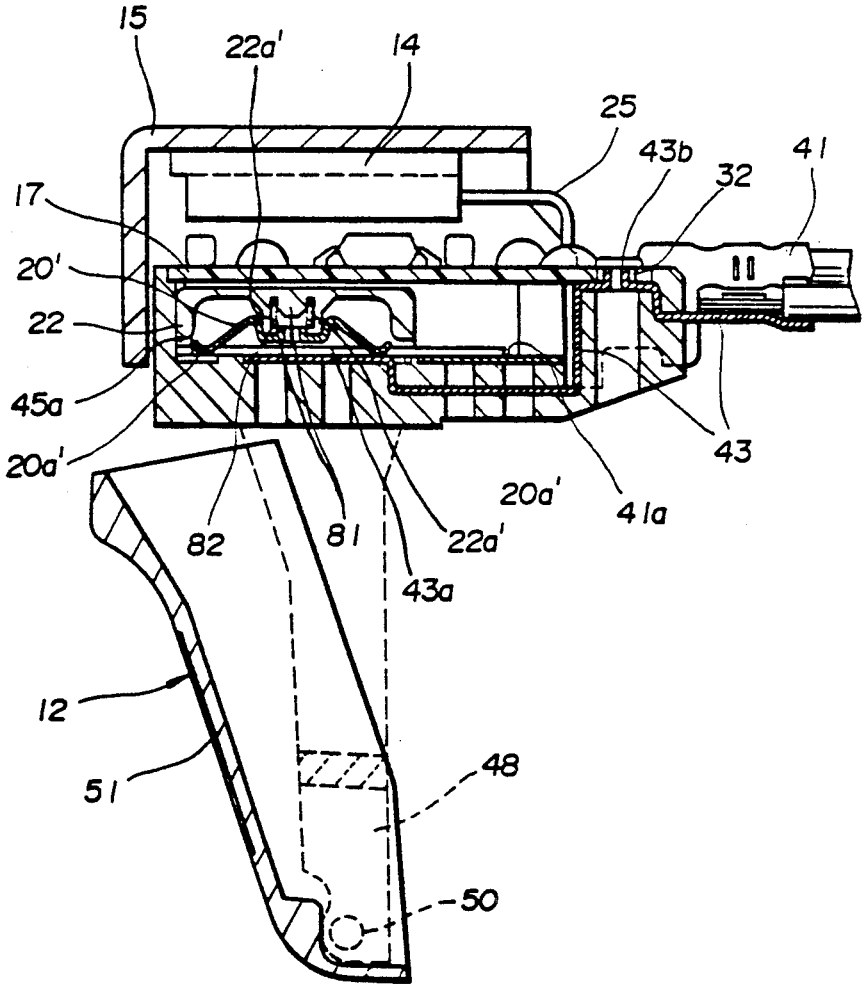
FIG. 16 is a sectional side view of the fourth embodiment of the present invention.
Figure 17:
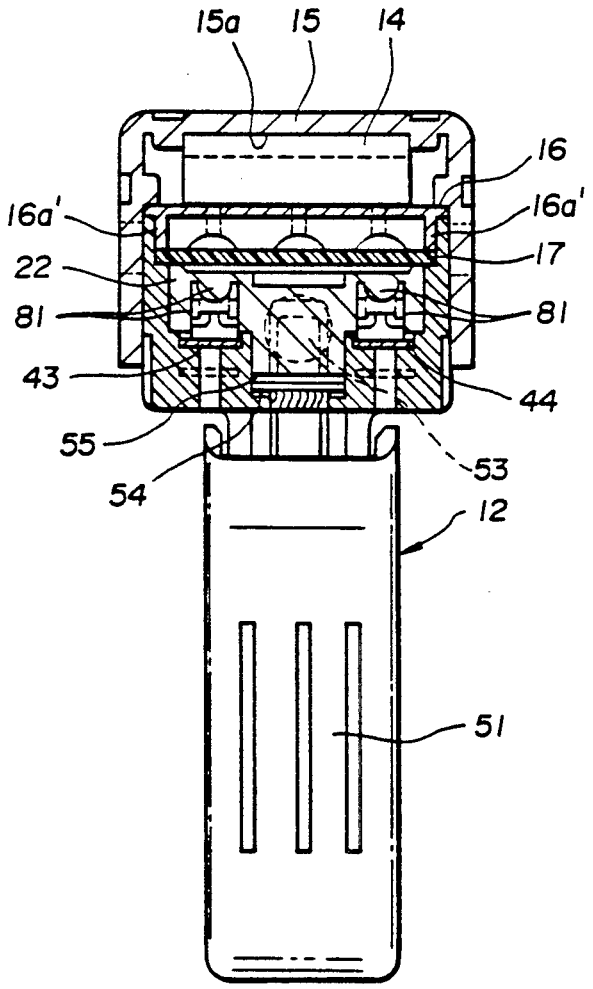
FIG. 17 is a sectional front view of the fourth embodiment.

Referring to FIGS. 15 through 17, the lower surface of the slider 22 is provided with two sets of recesses each set of which comprises a central circular recess 79, and a pair of larger recesses 78 located ahead and behind the central circular recess 79, respectively. The first and second moveable contact pieces 20' and 21' are each made by bending an electroconductive plate into the shape of letter "M"; the upwardly facing surface of the central depression 20*b'* or 21*b'* of each of the M-shaped moveable contact pieces 20' and 21' is engaged and pressed, from above, by a pair of depending engagement pieces 22*a'* projecting from the lower surface of the slider 22 while the two lower ends of the legs of the M-shaped moveable contact pieces 20' and 21' are curved into arcuate contact portions 20*a'*, 20*a'*, 21*a'* and 21*a'* so that they may be aligned along the sliding direction one behind the other and slidably engaged with the contact surfaces 41*a* through 45*a* in a planar fashion. The required biasing forces are derived from coil springs 82 and 82.

The coil springs 82 and 82 are interposed between the bottom surface of the gap between the depending pieces 22*a'* of the slider 22 and the upwardly facing surface of the central depressions 20*b'* and 21*b'* of the moveable contact pieces 20' and 21', respectively, in compressed state, to urge the moveable contact pieces 20' and 21' downwardly. Thus, the moveable contact pieces 20' and 21' can apply a constant biasing force to the contact surfaces so as to achieve an optimum state of contact by receiving the spring force from the coil springs 82 which are provided with a low spring constant and a favorable biasing force supporting capability.

Figure 18:
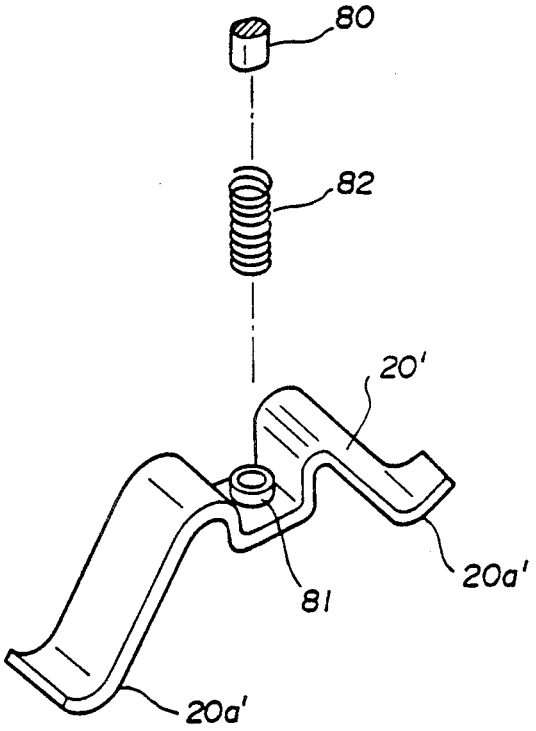
FIG. 18 is an exploded and enlarged perspective view showing one of the moveable contact pieces in greater detail.
Figure 19:
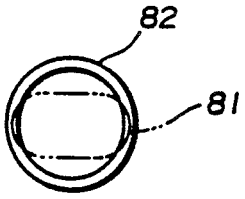
FIG. 19 is an end view of one of the coil springs which urge the moveable contact pieces downward.

For the convenience of assembling the coil springs 82, as shown in FIGS. 18 and 19, elliptic spring retainers 80 and 81 are provided in the parts of the slider 22 and the parts of the moveable contact pieces 20' and 21', respectively, which, from above and below, oppose the two ends of the coil springs 82, so as to protrude in an elliptic shape having a major diameter which is slightly larger than the inner diameter of the coil springs 82.

Thereby, once the coil springs 82 are fitted onto these elliptic spring retainers 80 and 81 with a certain pressure, the coil springs 82 are secured to the elliptic spring retainers 80 and 81 in a simple manner.

When installing the moveable contact pieces 20' and 21', one end of each of the coil springs 82 is fitted onto the corresponding elliptic spring retainer 81 provided thereon, and after the coil springs 82 are attached to the moveable contact pieces 20' and 21', they can be treated as single component parts, whereby a substantial advantage is gained in the simplification of the handling of the coil springs 82 and the improvement of the assembly work efficiency.

Thus, by applying biasing force to the moveable contact pieces with the coil springs, a stable pressure which is suitable for the contacts in the switch mechanism is obtained. Furthermore, since the coil springs are retained by the elliptic spring retainers, the installed coil springs stay in position so as to simplify the assembly work and to realized a reliable assembly work without involving inadvertent omission of the coil springs due to the movements of the coil springs by their own weight or vibrations and impacts. Thus, the switch contact units having a high contact reliability can be assembled in a highly efficient manner.

Figure 20:
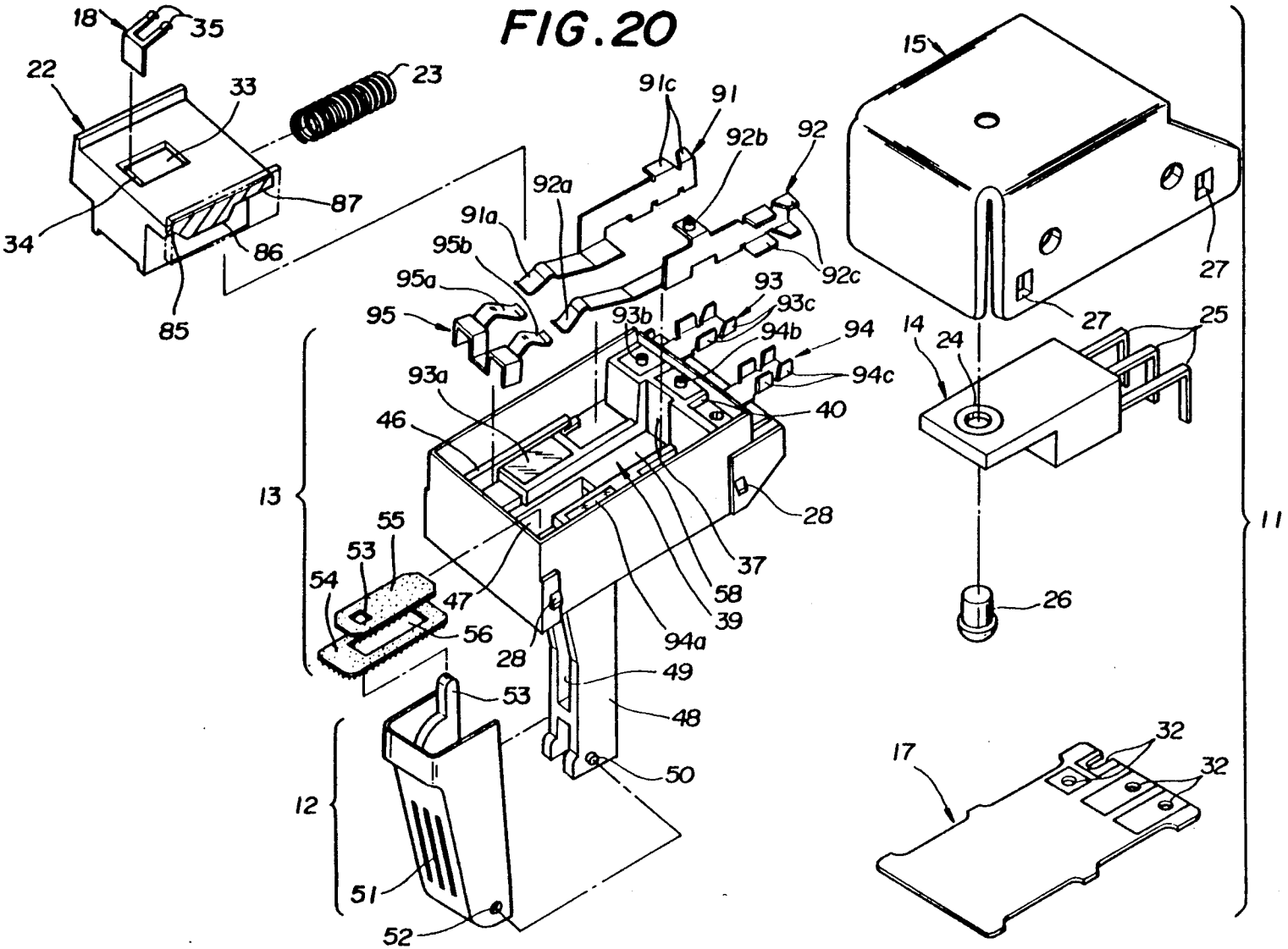
FIG. 20 is an exploded perspective view of a fifth embodiment of the electric switch for a power tool according to the present invention.
Figure 21:
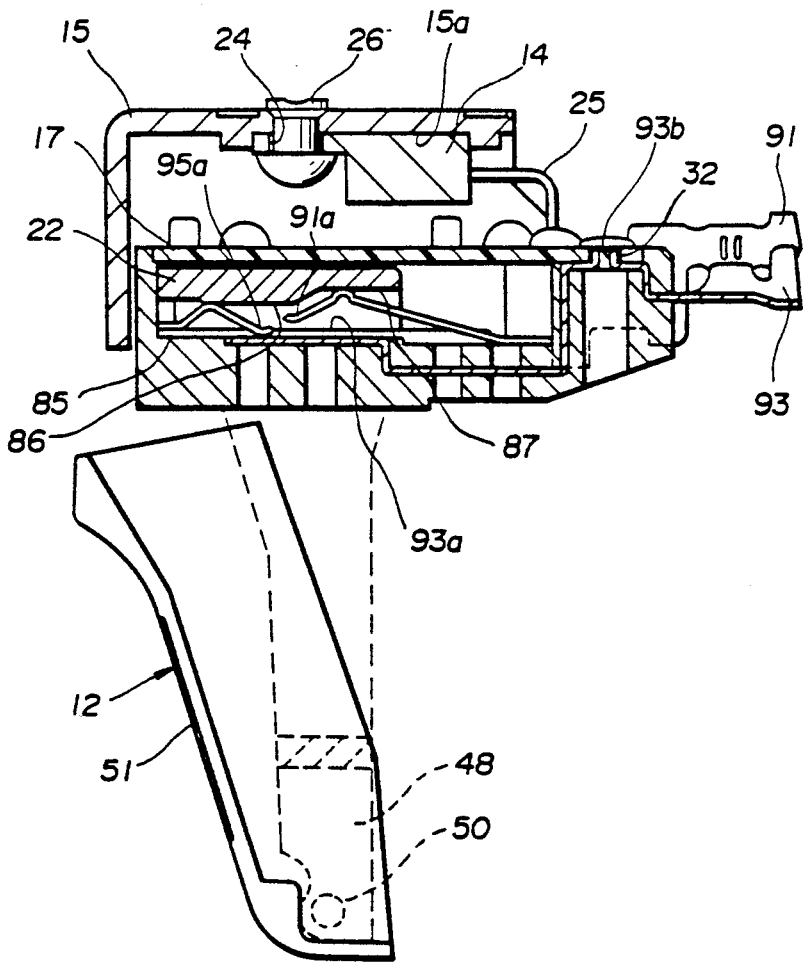
FIG. 21 is a sectional side view of the fifth embodiment of the present invention.
Figure 22:
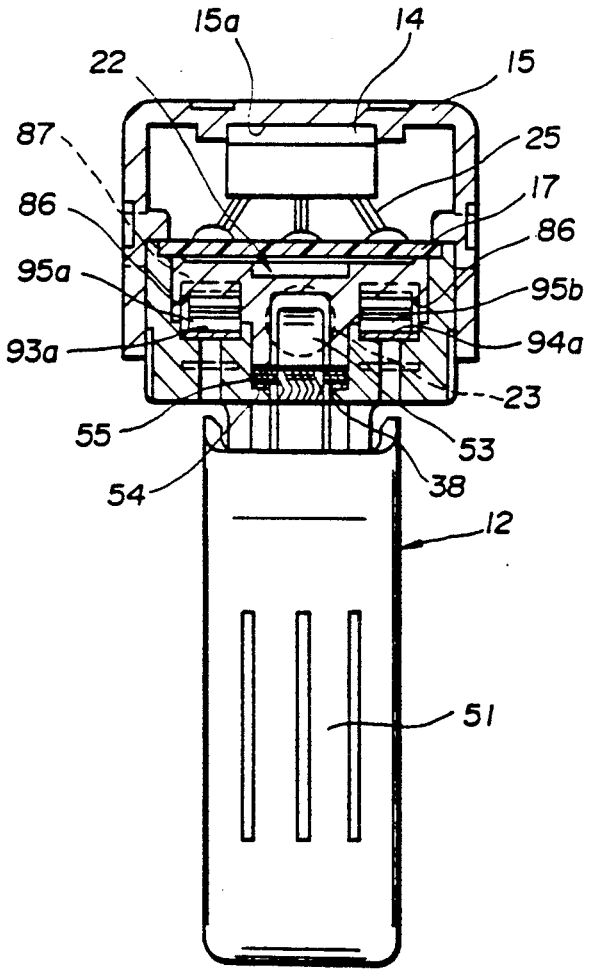
FIG. 22 is a sectional front view of the fifth embodiment.

In assembling a switch of this type, the mounting of the moveable contact pieces is a major factor in complicating the assembling process. The embodiment illustrated in FIGS. 20 through 22 does not require the parts corresponding to the moveable contact pieces used in the preceding embodiments. According to the present embodiment, the lower surface of the slider 22 is provided with first through third cam surfaces 85 through 87 arranged along the fore-and-aft direction, instead of metallic contact pieces. The second cam surface 86 located in the middle protrudes more downwardly than the other cam surfaces 85 and 87 located adjacent thereto.

A brake contact piece 95 is provided in the front most part of the bottom surface of the upper opening 39 of the switch casing 13. The brake contact piece 95 consists of a base portion which extends laterally and is press fitted into the suitable recess provided in the bottom surface, and a pair of elastic pieces 95*a* extending rearwardly from lateral end portions of the base portion.

A pair of motor terminals 93 and 94 are insert molded with the switch casing 13 along either side portion of the switch casing 13 in mutually parallel relationship, and their internal ends define contact surfaces 93*a* and 94*a* located to the rear of the brake contact piece 95 and serving as common contact pieces as described hereinafter while their outer ends projecting rearwardly from the rear wall 40 of the switch casing 13 are formed as crimping terminal connection portions 93*c* and 94*c* for connecting external lead wires thereto by crimping.

Further, a pair of power source terminals 91 and 92 are press fitted into the switch casing 13 on either outer side of the motor terminals 93 and 94 also in parallel thereto, and their internal ends are formed as elastic pieces 91*a* and 92*a* while their outer ends projecting rearwardly from the rear wall 40 of the switch casing 13 are likewise formed as crimping terminal connection portions 91*c* and 92*c* for connecting external lead wires thereto by crimping.

The elastic pieces 95*a*, 91*a* and 92*a* are located above the corresponding contact surfaces 93*a* and 94*a* defining a certain gap thereto, in their natural conditions.

When the slider 22 is located at the front most position under the spring force of the return spring 23, the second cam surface 86 presses upon the elastic pieces 95*a* of the brake contact piece 95 and brings the elastic pieces 95*a* into contact with the contact surfaces 93*a* and 94*a*, respectively, against the spring forces of the elastic pieces 95*a*, while the elastic pieces 91*a* and 92*a* are spaced from the contact surfaces 93*a* and 94*a*, respectively, under their own spring forces. Therefore, the motor terminals 91 and 92 are directly connected to each other by way of the brake contact piece 95, and the stationary state of the motor can be attained.

When the slider 22 is moved rearwardly from the front most position, the second cam surface 86 presses upon the elastic pieces 91*a* and 92*a* of the first and second power source terminals 91 and 92 and brings the elastic pieces 91*a* and 92*a* into contact with the contact surfaces 93*a* and 94*a*, respectively, against the spring forces of the elastic pieces 91*a* and 92*a*, while the elastic pieces 95*a* are spaced from the contact surfaces 93*a* and 94*a*, respectively, under their own spring forces. Therefore, the motor terminals 91 and 92 are connected to the power source by way of a switch circuit not shown in the drawings and the motor is driven in either direction.

Thus, the elastic pieces 91*a*, 92*a* and 95*a* serve as both pressure springs and contact pieces. Through reduction of the number of component parts and the simplification of the assembly process, the present embodiment can offer a substantial advantage in the reduction of cost.

What we claim is:

1. An electric switch for a power tool, comprising:

a slider slidably received in a switch casing along a longitudinal direction and retained in said switch casing;

handle means for manually actuating said slider along said longitudinal direction, said handle means being pivotally retained in said switch casing;

a plurality of fixed contact pieces comprising a common brake contact piece provided in one longitudinal end of said bottom surface of said switch casing, a pair of laterally spaced power source contact pieces arranged in the other longitudinal end of said bottom surface of said switch casing, and a pair of laterally spaced motor contact pieces each arranged between said brake contact piece and one of said power source contact pieces, provided with contact surfaces located substantially in a same plane;

a plurality of moveable contact pieces consisting of a pair of laterally arranged contact pieces retained in the bottom surface of said slider and urged toward said fixed contact pieces by spring means so as to selectively contact at least some of said contact surfaces of said fixed contact pieces;

each of said moveable contact pieces contacting and achieving a conductive state with one of said motor contact pieces to said brake contact piece or one of said power source contact pieces depending on the longitudinal sliding position of said slider.

2. An electric switch as defined in claim 1, wherein each of said moveable contact pieces consists of a substantially planar member having an arcuate portion at either longitudinal end thereof, and said spring means consists of a sheet spring interposed between the lower surface of said slider and the upper surface of each of said moveable contact pieces.

3. An electric switch as defined in claim 1, wherein each of said moveable contact pieces consists of an M-shaped metal strip having an upwardly convex middle part for engaging this moveable contact piece to said slider and a pair of downwardly extending legs at either longitudinal end thereof for contact with said contact surfaces of said fixed contact pieces, and said spring means consists of the parts of said moveable contact pieces located between said middle parts and said legs which are adapted for elastic bending deformation.

4. An electric switch as defined in claim 1, wherein each of said moveable contact pieces consists of an M-shaped metal strip having an upwardly convex middle part engaged to said slider and a pair of downwardly extending legs at either longitudinal end thereof for contact with said contact surfaces of said fixed contact pieces, and said spring means consists of coil springs which are interposed between said upwardly convex middle parts of said moveable contact pieces and the lower surface of said slider.

5. An electric switch as defined in claim 4, wherein at least said upwardly convex middle part of each of said moveable contact pieces or the part of said lower surface of said slider for receiving each respective end of one of said coil springs being provided with a projection for elastically engaging the inner circumferential surface of said coil spring.

6. An electric switch as defined in claim 1, wherein said first and second motor contact pieces are originally connected to each other by way of said brake contact piece, and the member which connects the brake contact piece with one of said first and second motor contact pieces is entirely located externally of said switch casing so as to allow simultaneous arrangement of said first and second motor contact pieces and said brake contact piece, and so that said member can be removed after said contact pieces are insert molded with said switch casing.

7. An electric switch as defined in claim 1, wherein a printed circuit board carrying a resistor surface printed on its lower surface is placed on the upper part of said switch casing, and said slider is provided, on its upper surface, with a brush which slides over said printed resistor surface.

8. An electric switch as defined in claim 7, further comprising an inner cover having a depending piece which presses upon a peripheral part of said printed circuit board against a shoulder surface provided in said upper part of said switch casing, and an outer cover which fits onto and securely engages with the outer peripheral surface of said switch casing.

9. An electric switch as defined in claim 8, wherein said outer cover consists of highly heat conductive material.

10. An electric switch as defined in claim 9, wherein said inner cover is also made of highly heat conductive material.

11. An electric switch as defined in claim 1, wherein each of said fixed contact pieces is connected to corresponding terminals which are passed through a wall part of said switch casing located at a longitudinal end thereof, and said terminals are provided with annular end upward projections which are received by corresponding holes provided through printed electroconductive patterns of a printed circuit board carrying a control circuit for controlling the motor of the power tool and secured to the upper end of said switch casing, and leads extending from an external circuit are inserted into said annular projections, each of said annular projections being soldered to the corresponding printed electroconductive pattern of said printed circuit board and the corresponding lead of said external circuit.

12. An electric switch as defined in claim 1, wherein said handle means consists of a lever which is passed through a slot defined in a lower part of said switch casing and is pivotally supported by a pin which extends from said switch casing, said lever being provided with engagement means for acting upon said slider to cause said longitudinal movement by way of a pivotal movement of said lever and manual actuation surface for manually causing said pivotal movement of said actuation lever.

13. An electric switch as defined in claim 12, wherein said slot is sealed by a fixed elastic strip which defines a central opening for accommodating said pivotal movement of said lever, and a moveable elastic strip which is placed over said fixed elastic strip and is provided with a central engagement hole which receives the inner end of said lever such that said moveable elastic strip moves in response to pivotal movement of said lever.

14. An electric switch as defined in claim 13, wherein said inner end of said lever is provided with means for engagement with said slider for converting said pivotal movement of said lever into said sliding movement of said slider, an arcuate projection extending along said longitudinal direction which is received by said slot in said lower part of said switch casing, and a pair of shoulder surfaces for guiding said slider which are located on either side of said arcuate projection and adjoin the lower surface of said switch casing peripheral to said slot.

15. An electric switch as defined in claim 14, wherein said fixed contact pieces are arranged on a plane which is substantially higher than the plane on which said elastic strips are placed.

* * * * *